US006062057A

United States Patent [19]

Minnerop

[11] Patent Number: 6,062,057

[45] Date of Patent: May 16, 2000

[54] UNIVERSAL ROLL STAND

[75] Inventor: Michael Minnerop, Ratingen, Germany

[73] Assignee: SMS Schloemann-Siemag Aktiengesellschaft, Düsseldorf, Germany

[21] Appl. No.: 09/282,697

[22] Filed: Mar. 31, 1999

[30] Foreign Application Priority Data

Apr. 11, 1998 [DE] Germany ..... 198 16 319

[51] Int. Cl.[7] ..... B21B 13/10

[52] U.S. Cl. ..... 72/225

[58] Field of Search ..... 72/224, 225, 238, 72/239, 237, 246, 245

[56] References Cited

U.S. PATENT DOCUMENTS 5,457,979 10/1995 Castellani ..... 72/225

FOREIGN PATENT DOCUMENTS 0178462 4/1986 European Pat. Off. .
0703016 3/1996 European Pat. Off. .

*Primary Examiner*—Rodney C Butler
*Attorney, Agent, or Firm*—Friedrich Kueffner

[57] ABSTRACT

A universal roll stand including a multiple-part stationary roll housing on the drive side and a multiple-part roll housing on the operator side which can be moved away, wherein the housings are connected to each other through hydraulically pretensioned tie rods or the like. The roll housings are composed of conventional two-high housing frames and vertical frames which can be fixedly anchored to the two-high housing frames. The vertical frames may be composed of several parts and include two flange-mounted beams arranged spaced apart from each other by the distance between the housing beams of the roll stand and a crosshead connected to the flange-mounted beams.

3 Claims, 3 Drawing Sheets

UNIVERSAL ROLL STAND

BACKGROUND OF THE INVENTION

1. Field of the Invention

The present invention relates to a universal roll stand including a multiple-part stationary roll housing on the drive side and a multiple-part roll housing on the operator side which can be moved away, wherein the housings are connected to each other through hydraulically pretensioned tie rods or the like.

2. Description of the Related Art

In addition to roll sets with roll axes extending parallel to each other and horizontally, universal roll stands of this type simultaneously contain roll sets with roll axes which extend parallel to each other and vertically. The roll housings are usually cast as a single piece, primarily because the roll sets with the vertical roll axes must be supported and braced by outwardly cantilevering support projections which extend laterally of the vertical roll housings.

In order to be able to simplify the manufacturing process, it has become known from EP 0 703 016A2 to divide the roll housings of the universal roll stand into several individual components which can be easily manufactured and to later screw these individual components together or to hydraulically pretension the individual components by means of tie rods.

SUMMARY OF THE INVENTION

Therefore, it is the primary object of the present invention to provide a universal roll stand of the above-described type which is even simpler and less expensive with respect to casting technology and manufacturing technology.

In accordance with the present invention, the roll housings are composed of conventional two-high housing frames and vertical frames which can be fixedly anchored to the two-high housing frames.

Such two-high housing frames are disclosed, for example, in EP 0 178 462A1, wherein the occurring horizontal forces are absorbed by hydraulically pretensioned tie rods which are arranged in the roll housing so as to be swingable in and out on the operator side and which, in the swung-in position, are received in housing grooves which are open outwardly to both sides. The solution according to the present invention provides for a universal roll stand of the above-described type in a simple manner to equip such housing frames with vertical frames which serve for the lateral support of the vertical roll set and which absorb the rolling forces. The vertical frames can be screwed to the two-high housing frames. However, in accordance with the solution of the present invention, the tie rods which extend vertically in the position of operation are not necessarily required. It is no longer necessary to produce the housing frames with outwardly cantilevering support projections which are complicated with respect to casting technology; rather, the support projections can be manufactured in a separate work step and they merely have to be screwed on in the form of the vertical frames in order to meet the requirements for a universal roll stand.

In accordance with a further development of the invention, the vertical frames are composed of several parts and include two flange-mounted beams arranged spaced apart from each other at the distance between the housing beams of the roll stand and a crosshead connected to the flange-mounted beams. Dividing the vertical frame into individual components which, in the simplest case, are to be screwed together, leads to a further simplification in the manufacture of the stand. This is because all required individual components can be cast separately essentially as flat components, and can then be processed and also transported.

In accordance with an advantageous feature, the flange-mounted beams are provided with centering sleeves which are in alignment with the tie rods. This makes it possible to use the hydraulically pretensioned tie rods, which already connect the two roll housings and are horizontally arranged at the top and the bottom, simultaneously for securing the vertical frames to the housing beams.

In accordance with the present invention, the universal roll stand further includes threaded bolts extending from the crosshead of the vertical frame on the operator side and through the crosshead of the vertical frame on the drive side so as to be able to connect the crossheads of the two vertical frames with a single component to the flange-mounted beams braced against the roll housings through the tie rods.

The various features of novelty which characterize the invention are pointed out wit h particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
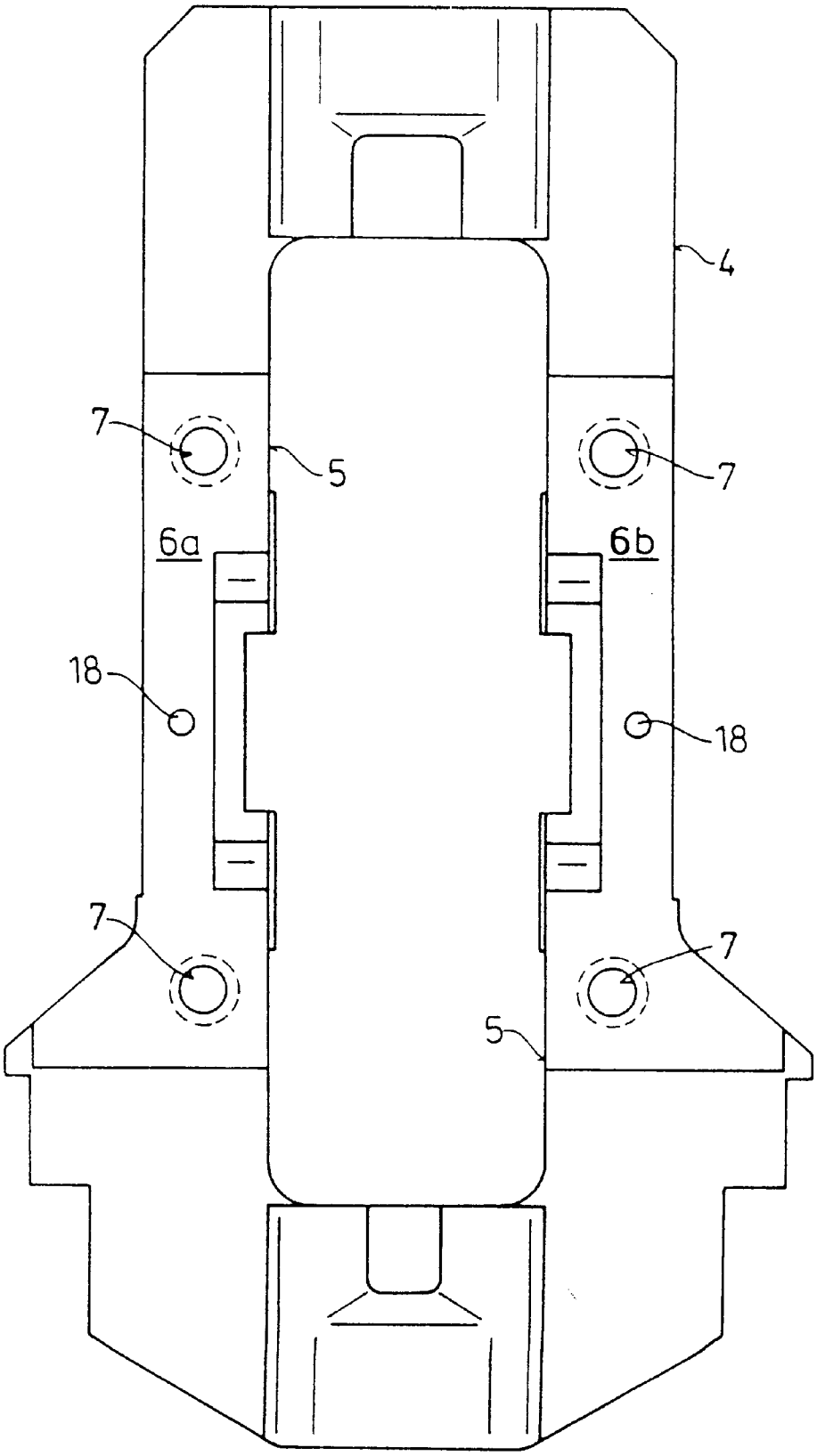
FIG. 1 is a front view of a two-high housing frame used in a universal roll stand.
Figure 4:
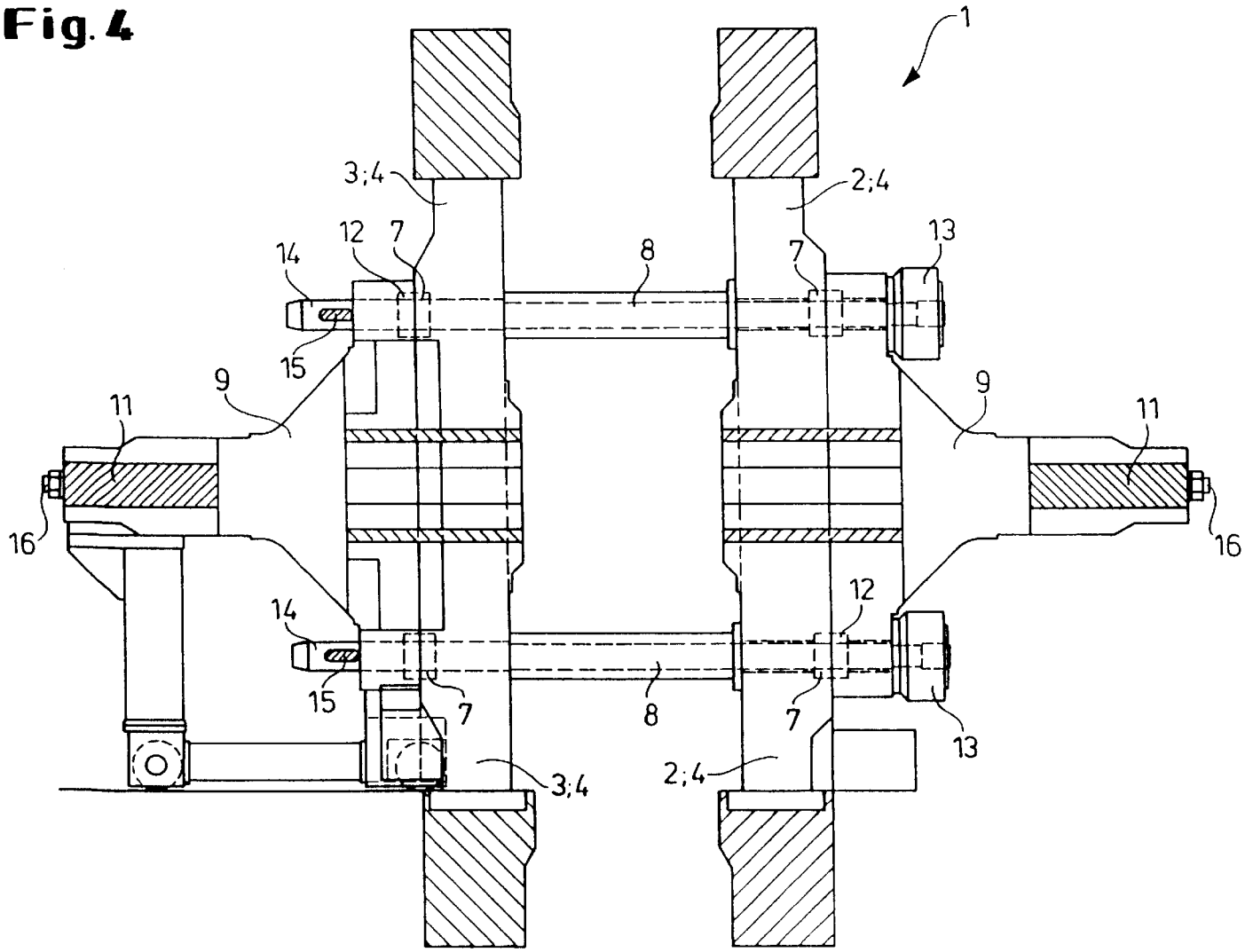
FIG. 4 is a longitudinal sectional view of a universal roll stand composed of two two-high housing frames of the type illustrated in FIG. 1 and with vertical frames anchored to the housing frames.

A universal roll stand 1 shown in FIG. 4 is composed of a roll housing 2 on the drive side and a roll housing 3 on the operator side which, for carrying out a roll exchange, may be movable away from the stationary roll housing 2 on the drive side. The roll housing 2 on the d rive side as well as the roll housing 3 on the operator side are based on two-high housing frames 4 as illustrated in FIG. 1 and as used in a conventional two-high stand. In its housing beams 6*a*, 6*b*which laterally form the window opening 5, the frame 4 is provided with centering sleeves 7 which extend in alignment with two upper tie rods and two lower tie rods, i.e., altogether four tie rods 8, wherein FIG. 4 shows an upper tie rod and a lower tie rod; the complementary tie rods are located in the rear and are not visible in the drawing plane.

Figure 3:
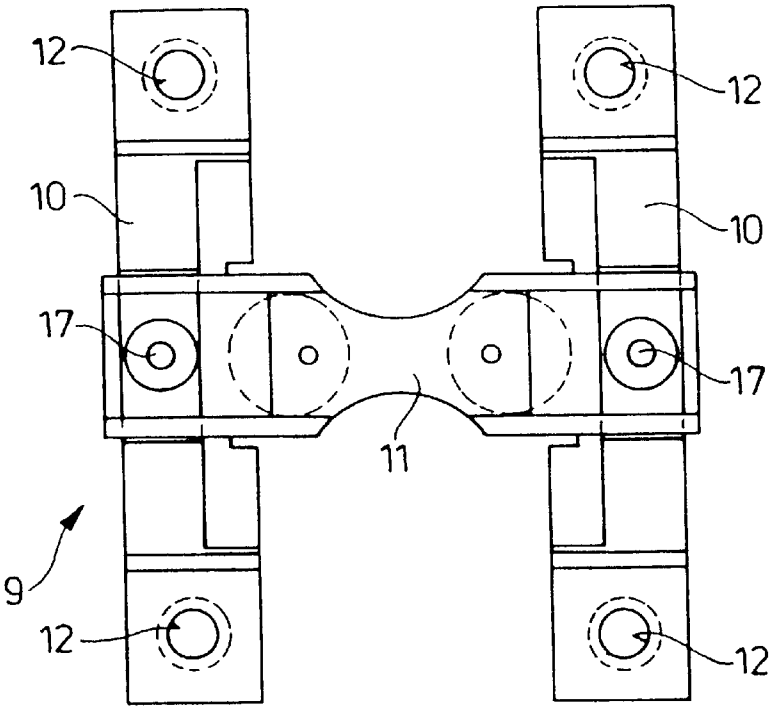
FIG. 3 is a rear view of the vertical frame of FIG. 2.
Figure 2:
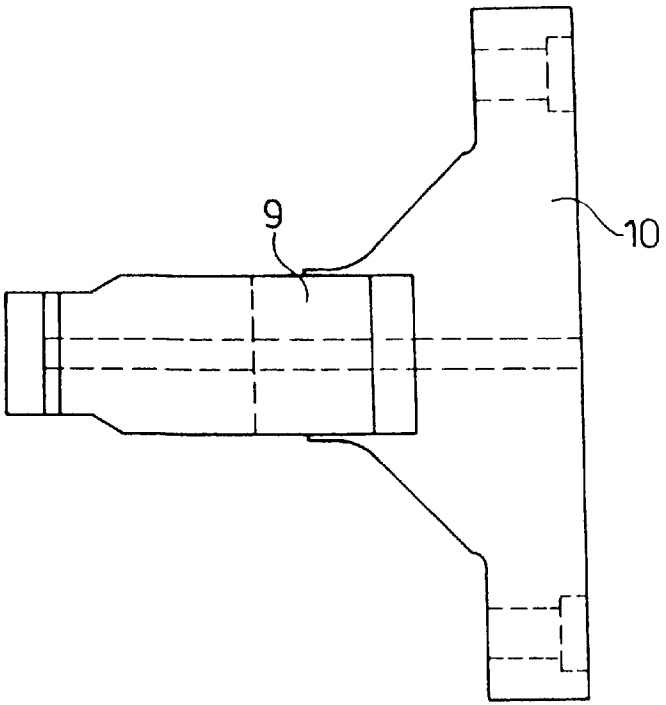
FIG. 2 is a side view of a vertical frame which can be anchored to the two-high housing of FIG. 1.

In order to form the universal roll stand 1, vertical frames 9 illustrated in FIGS. 2 and 3 are anchored to the two-high housing frames 4 or the roll housings 2, 3. The vertical frames 9 are composed of several components and include two flange-mounted beams 10 which are arranged spaced apart by the distance between the housing beams 6*a*, 6*b* of the roll housings 2, 3 or the two-high housing frame 4 and, as shown in FIG. 3, are connected to each other through a crosshead 11 which bridges this distance. The flange-mounted beams 10 are also provided with centering sleeves 12 which, in the mounted position as shown in FIG. 4, are in alignment with the centering sleeves 7 of the housing beams 6*a*, 6*b*. Consequently, the tie rods 8 which have on the drive side a hydraulic tensioning head 13 and through which the two roll housings 2, 3 are braced together as illustrated in FIG. 4, are secured in their positions by these centering sleeves.

A counter-component, not shown in FIG. 4, is secured by means of a wedge 15 on the tie rods 8 which with a free end 14 protrude out of the roll housing 3 on the operator side. In the illustrated embodiment, the crossheads 11 are secured by means of single-piece threaded bolts 16, wherein correspondingly aligned bores 17, as seen in FIG. 3, or bores 18, as seen in FIG. 1, are provided for the threaded bolts 16 in the crossheads 11 as well as in the flange-mounted beams 10 and the housing beams 6*a*, 6*b* of the two roll housings 2, 3 or the two-high housing frame 4. Thus, the threaded bolts 17 extend starting from the crossheads 11 over the entire width of the universal roll stand 1.

Accordingly, the configuration of the universal roll stand 1 according to the present invention makes it possible to manufacture the stand in a simple manner with respect to casting and manufacturing technology because vertical frames 9 which are of simple construction are anchored to two-high housing frames which are essentially provided with smooth surfaces.

While specific embodiments of the invention have been shown and described in detail to illustrate the inventive principles, it will be understood that the invention may be embodied otherwise without departing from such principles.

I claim:

1. A universal roll stand comprising a multiple-part stationary roll housing on a drive side and a multiple-part roll housing on an operator side configured to be moved out, and hydraulically tensioned tie rods connecting the roll housings, wherein the roll housings are comprised of conventional two-high housing frames and vertical frames configured to be rigidly anchored to the two-high housing stands, wherein each vertical frame is comprised of two flange-mounted beams arranged at a distance from each other corresponding to a distance between housing beams of the roll housings, and a crosshead connected to the flange-mounted beams.

2. The universal roll stand according to claim 1, wherein the flange-mounted beams and the housing beams are provided with centering sleeves which are in alignment with the tie rods.

3. The universal roll stand according to claim 1, comprising threaded bolts extending from the crosshead of the vertical frame on the operator side through the crosshead of the vertical frame on the drive side.

* * * * *